US009649835B2

(12) United States Patent
Czerner

(10) Patent No.: US 9,649,835 B2
(45) Date of Patent: May 16, 2017

(54) PRINTING BLANKET INCLUDING A NON-EXTENSIBLE BACKING LAYER AND A RELIEF AREA WHICH MAY BE MOUNTED IN A VARIETY OF LOCKUP MECHANISMS

(71) Applicant: Day International, Inc., Dayton, OH (US)

(72) Inventor: Richard L. Czerner, Weaverville, NC (US)

(73) Assignee: Day International, Inc., Dayton, OH (US)

( * ) Notice: Subject to any disclaimer, the term of this patent is extended or adjusted under 35 U.S.C. 154(b) by 583 days.

(21) Appl. No.: 14/301,730

(22) Filed: Jun. 11, 2014

(65) Prior Publication Data

US 2014/0290514 A1 Oct. 2, 2014

Related U.S. Application Data

(63) Continuation of application No. 11/593,871, filed on Nov. 7, 2006, now Pat. No. 8,783,178.

(60) Provisional application No. 60/734,872, filed on Nov. 9, 2005.

(51) Int. Cl.

| | |
|---|---|
| ***B41F 21/00*** | (2006.01) |
| ***B41F 13/10*** | (2006.01) |
| ***B41N 10/06*** | (2006.01) |
| ***B41F 27/12*** | (2006.01) |
| *B41F 27/10* | (2006.01) |

(52) U.S. Cl.

CPC ..... *B41F 13/10* (2013.01); *B41F 27/12* (2013.01); *B41N 10/06* (2013.01); *B41F 27/10* (2013.01)

(58) Field of Classification Search

CPC ..... B41F 27/12; B41F 27/10; B41F 27/1287; B41F 30/00; B41F 30/04; B41F 27/1293

See application file for complete search history.

(56) References Cited

U.S. PATENT DOCUMENTS

| | | | |
|---|---|---|---|
| 3,295,443 | A | 1/1967 | Devon |
| 3,489,085 | A | 1/1970 | Kirkpatrick |
| 3,730,092 | A | 5/1973 | Pickard et al. |
| 4,073,177 | A | 2/1978 | Leroux |
| 4,744,297 | A | 5/1988 | Sardella et al. |

(Continued)

FOREIGN PATENT DOCUMENTS

| | | | |
|---|---|---|---|
| JP | 7017157 | A | 1/1995 |
| JP | 2002326341 | A | 11/2002 |

(Continued)

OTHER PUBLICATIONS

Japanese Patent Application No. 2008-540198 Office Action dated Feb. 24, 2012 (English Translation).

*Primary Examiner* — David Banh

(74) *Attorney, Agent, or Firm* — Dinsmore & Shohl LLP

(57) ABSTRACT

A printing blanket is provided which may include a printable surface ply, a compressible ply, one or more reinforcing fabric plies, and a non-extensible backing layer comprising a polymeric material. The printing blanket has first and seconds ends which are adapted to be inserted into the gap of a printing blanket cylinder, where each of the first and second ends may include a relief area formed by removing or molding a portion of the blanket or by removing or molding a portion of the non-extensible backing layer such that the blanket may be mounted in a wide variety of printing presses using a number of different lock-up mechanisms.

21 Claims, 4 Drawing Sheets

(56) References Cited

U.S. PATENT DOCUMENTS

| | | | |
|---|---|---|---|
| 4,829,896 | A | 5/1989 | Norkus |
| 5,006,400 | A | 4/1991 | Pinkston et al. |
| 5,203,069 | A | 4/1993 | Hennig |
| 5,357,863 | A | 10/1994 | McLean et al. |
| 5,366,799 | A | 11/1994 | Pinkston et al. |
| 5,549,968 | A | 8/1996 | Byers et al. |
| 5,644,985 | A | 7/1997 | Serain et al. |
| 5,732,630 | A | 3/1998 | Puschnerat et al. |
| 5,749,298 | A | 5/1998 | Castelli et al. |
| 5,768,990 | A | 6/1998 | Vrotacoe et al. |
| 5,934,194 | A | 8/1999 | Puschnerat et al. |
| 6,019,042 | A | 2/2000 | Batti et al. |
| 6,125,765 | A | 10/2000 | Loomer |
| 6,530,321 | B2 | 3/2003 | Andrew et al. |
| 6,539,865 | B2 | 4/2003 | Friedman |
| 6,912,955 | B2 | 7/2005 | Invernizzi et al. |
| 7,399,526 | B2 | 7/2008 | Dalmais et al. |
| 2001/0017214 | A1 | 8/2001 | Saeki et al. |
| 2003/0124926 | A1 | 7/2003 | Moscato et al. |
| 2003/0129896 | A1 | 7/2003 | Risquez et al. |
| 2004/0159256 | A1 | 8/2004 | Hertzog et al. |
| 2005/0098051 | A1 | 5/2005 | Flint et al. |
| 2005/0235849 | A1 | 10/2005 | Lorig et al. |

FOREIGN PATENT DOCUMENTS

| | | | |
|---|---|---|---|
| JP | 2003025019 | A | 1/2003 |
| JP | 2004262212 | A | 9/2004 |
| JP | 2008002651 | A | 1/2008 |
| WO | WO9309941 | | 5/1993 |
| WO | WO0170512 | A1 | 9/2001 |
| WO | WO2005047011 | A1 | 5/2005 |

PRINTING BLANKET INCLUDING A NON-EXTENSIBLE BACKING LAYER AND A RELIEF AREA WHICH MAY BE MOUNTED IN A VARIETY OF LOCKUP MECHANISMS

CROSS REFERENCE TO RELATED APPLICATIONS

This application is a continuation of U.S. patent application Ser. No. 11/593,871, filed Nov. 7, 2006, which claims the benefit of U.S. Provisional Application No. 60/734,872 filed Nov. 9, 2005. The entire contents of said applications are hereby incorporated by reference.

BACKGROUND OF THE INVENTION

The present invention relates to a printing blanket having a non-extensible backing layer and including at least one relief area, and more particularly, to a printing blanket which may be mounted in a wide variety of printing presses using a number of different lockup mechanisms.

One of the most common commercial printing processes is offset lithography. In this printing process, ink is offset from a printing plate to a rubber-surfaced printing blanket mounted on a blanket cylinder before being transferred to a substrate, such as paper. Typically, the blanket cylinder comprises a chrome or nickel-plated steel cylinder having a longitudinal opening or "gap" therein. An encircling rubber printing blanket is releasably mounted onto the cylinder with opposing ends of the blanket being fed into the cylinder gap and secured by a locking mechanism within the gap. The printing blanket is typically reinforced with a number of fabric and/or rubber plies along with either a fabric or metal backing. The use of a metal backing is often preferable as it prevents stretching of the blanket when it is mounted on the blanket cylinder. The metal backing also provides dimensional stability to the blanket, resulting in high print quality, and eliminates the need for frequent retensioning of the blanket as would be required with conventional fabric-backed blankets.

There are currently a number of different types of lockup mechanisms used in the printing industry to secure printing blankets into the cylinder gap. In most conventional presses, blanket bars are typically secured to each end of the blanket and the ends are inserted into the gap and secured with a lockup device.

In recent years, manufacturers of offset printing processes have equipped newer presses with a "plate" type lockup mechanism which allows the use of metal-backed or non-tensioned blankets and which achieves a very narrow printing gap. The use of the newer presses in combination with a metal-backed blanket provide faster printing speed, higher quality print, longer blanket life, and reduced non-print length compared to standard tensioned blankets which are used with conventional bar lockup devices.

However, blankets containing a metal backing are difficult to mount and tension properly on a blanket cylinder which uses more conventional mounting mechanisms such as single or dual reel rods or "t-bar" type lockups. This is due to the metal at the leading and trailing ends of the blanket which is relatively inflexible and difficult to feed into the cylinder gap. In addition, the stiffness of the metal-backed blankets makes it difficult to mount the blankets around small diameter printing cylinders.

Further, metal backed blankets are expensive to manufacture due to the complex processes required to assemble and finish the blankets to the precise dimensions and specifications required in printing processes.

Accordingly, there is still a need in the art for a printing blanket having a non-extensible backing which provides high print quality, and which may be easily mounted in a variety of printing presses and lock-up mechanisms.

SUMMARY OF THE INVENTION

The present invention meets that need by providing a printing blanket construction including a non-extensible backing layer comprised of a polymeric material. By "non-extensible," I mean that the dimensions of the backing ply substantially resist stretching when conventional forces are encountered during normal mounting and operation of the blanket, particularly in the circumferential direction around the blanket cylinder. The blanket further includes a relief area formed in at least one end of the blanket or in at least one end of the non-extensible layer to allow the blanket to be mounted in a number of different lockup mechanisms. For example, the blanket may be fitted with bars, including single side bars such that it may be inserted into a number of different lockup mechanisms used in offset printing presses including, but not limited to, single reel rod, dual reel rod, t-bar, and plate lockup mechanisms.

According to one aspect of the present invention, a printing blanket is provided having first and second ends with at least one of the first and second ends being adapted to be inserted into the gap of a printing blanket cylinder. In one embodiment of the invention, the blanket comprises at least a printable surface ply and a non-extensible backing layer, where at least a portion of the blanket overlying the non-extensible backing layer and spaced inwardly from at least one end of the blanket has been removed or molded to form at least one relief area which extends across substantially the width of the blanket and which is defined by blanket walls on either side.

In an alternative embodiment of the present invention, the printing blanket comprises at least a printable surface ply and a non-extensible backing layer, where at least a portion of the non-extensible backing layer and spaced inwardly from at least one end of the blanket has been removed or molded to form at least one relief area.

Where the relief area is formed from a portion of the blanket, the relief area is preferably included at each of the first and second ends of the blanket. These relief areas preferably correspond with a corresponding area on a cylinder lockup mechanism to which the blanket is adapted to be secured. By forming such relief areas on the blanket, the non-extensible backing layer remains at the base of the blanket construction such that substantially all of the tensioning force is borne by the non-extensible backing layer. The relief areas allow the blanket to be fitted into the lockup mechanism without causing the gauge of the blanket to be reduced as the blanket is tensioned in the lockup mechanism. Thus, "sinking" of the blanket gauge at the cylinder gap is reduced or eliminated, and non-print gap width is thereby reduced.

The relief area(s) formed from a portion of the blanket may have a triangular, rectangular, or curved cross-section. Alternatively, the relief area(s) may have a trapezoidal cross-section. The relief area(s) may further include a beveled edge portion. The beveled edge preferably forms an angle of from about 10° to 30° with the surface of the blanket.

The printing blanket may include an optional sealant on at least a portion of the surface of the relief area(s) to aid in preventing water, ink, or chemicals from entering the exposed surfaces of the relief areas of the blanket during printing operations.

In embodiments where the relief area is formed in the non-extensible backing layer, the relief area is preferably included at each of the first and second ends of the blanket. A blanket bar is preferably attached to each of the relief area(s) such that the blanket bar extends beyond the ends of the blanket. This configuration allows the printing blanket to be mounted in a lockup mechanism by bending the bars into the cylinder gap.

In both embodiments of the invention, the printing blanket may further include a compressible ply positioned beneath the surface ply. The printing blanket may further include one or more reinforcing fabric plies positioned beneath the printable surface layer and/or the compressible ply. Where a portion of blanket is removed or molded to form the relief area(s), this portion may comprise the printable surface layer, the compressible layer, and/or one or more reinforcing fabric plies.

The non-extensible backing layer is preferably selected from an oriented polymeric material or a reinforcing material which has been impregnated with a polymeric material. The polymeric material is preferably selected from thermoplastic and thermosetting polymers. The reinforcing material is preferably selected from fibers, cord, woven or non-woven fabric, mesh, scrim, screen, film, and sheets. The polymeric material is preferably impregnated into the reinforcing material in a sufficient amount such that the polymer prevents or substantially restricts movement of the fibers or fiber bundles of the reinforcing material. The resulting non-extensible backing layer withstands the normal forces encountered in the printing process and resists stretching so that it is not necessary to frequently re-tension the blanket to maintain high print quality.

The non-extensible backing layer preferably has a thickness of from about 0.008 inches to about 0.025 inches (about 0.2 mm to about 0.6 mm). The printing blanket including the non-extensible backing layer has an elongation of less than about 0.2% at loads of about 50 to 150 lbf/inch (about 8.9 to 26.8 kg-f/cm) of width.

In use, the printing blanket is mounted on a blanket cylinder which includes a gap and a lockup mechanism within the gap, where each end of the blanket is mounted in the lockup mechanism. Each end of the blanket may include a blanket bar secured thereto as is conventional in the art. Where the blanket includes relief areas formed from the printing blanket portion, the relief area(s) are positioned such that when the ends of the blanket is inserted into the gap of the blanket cylinder, the blanket is bent along the relief area(s). The relief area(s) are positioned in the gap such that the leading and trailing ends of the printing blanket adjacent the relief areas are positioned directly above the points where the blanket bends into and enters the gap immediately above the lockup mechanism. Thus, the non-print gap width is minimized.

Where the blanket includes relief areas formed from the non-extensible backing layer, the portion of the blanket bars extending beyond the blanket ends are preferably bent into the gap and secured in the lockup mechanism.

Accordingly, it is a feature of the present invention to provide a printing blanket including a non-extensible backing layer and which includes at least one relief area in the blanket portion or in the non-extensible backing layer which allows the blanket to be mounted in a wide variety of printing presses and lock-up mechanisms. Other features and advantages of the invention will be apparent from the following description and the accompanying drawings.

DETAILED DESCRIPTION OF THE PREFERRED EMBODIMENTS

The printing blanket of the present invention including a non-extensible backing layer provides a number of advantages over prior metal or fabric backed blankets. Because the backing is comprised of a non-extensible material, it provides better print quality and printing efficiency over its operating life as it eliminates stretching and/or retensioning of the printing blanket during mounting and operation. And, by utilizing a polymeric material as a backing material, the printing blanket is less expensive to manufacture than blankets utilizing metal backings.

In addition, the blanket of the present invention is significantly easier to mount in standard press lockups than blankets utilizing metal backings. By providing the printing blanket of the present invention with relief areas at each end, the blanket may be used in substantially all conventional types of lockup mechanisms without requiring any modifications to the mechanisms or the use of any special lockup procedures. The blanket may also be mounted in presses using plate-type lockup mechanisms. This provides advantages over conventional fabric backed tensioned blankets and prior art metal-backed blankets which are suitable for use in only a few types of lockup mechanisms.

Figure 1:
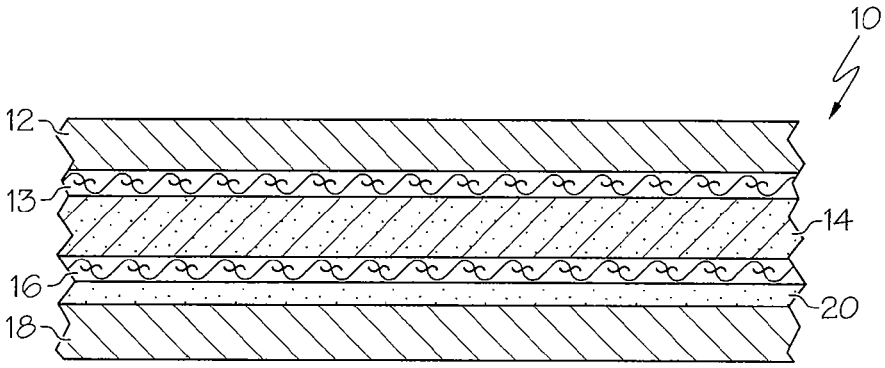
FIG. 1 is a cross-sectional view of a printing blanket including a non-extensible backing layer according to one embodiment of the present invention.

FIG. 1 illustrates a cross-sectional view of one embodiment of the printing blanket construction 10 of the present invention. The printing blanket 10 preferably includes at least an outer printing surface ply 12 which acts to transfer an inked image from a printing plate to a substrate, a compressible ply 14, one or more reinforcing fabric plies such as fabric plies 13 and 16, and a non-extensible backing ply 18. As shown, the plies 12, 14 and 16 are adhered to non-extensible backing layer 18 with an adhesive 20. The adhesive used to adhere the plies to the non-extensible backing layer may comprise any of a number of conventional adhesives including hot melt adhesives, pressure sensitive adhesives, and curable polymers including rubber, urethane, epoxies, and the like. Alternatively, the plies may be formed directly onto the non-extensible backing layer.

The non-extensible backing layer 18 preferably comprises a polymeric layer including a reinforcing material therein. The polymeric material may comprise a thermoplastic or thermoset polymer. Suitable thermoplastic polymers include polyamides, polyesters, polypropylene, polyethylene, polyurethane, ethylene vinyl acetate copolymers and ionomers, polyvinyl chloride, ethylene-acrylic acid or ethylene-methacrylic acid copolymers, acid or anhydride modified polymers, and any other flexible or semi-rigid thermoplastic polymers, i.e., those polymers having a modulus which allow easy mounting on a press cylinder.

Suitable thermosetting polymers include rubber, curable urethane, epoxy, polyester, polyamide, and any other flexible or semi-rigid crosslinked polymers.

Alternatively, an oriented polymer film or sheet may be used as the non-extensible backing layer, either with or without the inclusion of a reinforcing material. One suitable oriented polyester film or sheet for use in the present invention is Mylar®, available from DuPont. Other suitable oriented polymeric materials include nylon, polyethylene, polystyrene, polycarbonate, or polypropylene. It should be appreciated that where such oriented polymeric materials are used, it may not be necessary to include a reinforcing material, i.e., such materials are sufficiently non-extensible when used in a thickness of at least about 0.010 to 0.020 inches (0.25 mm to 0.51 mm) such that a reinforcing material is not needed.

It should be appreciated that any suitable polymer may be used as long as it can be impregnated into the reinforcing material in a manner which provides sufficient rigidity to "lock" the fibers or fiber bundles of the reinforcing material to substantially restrict their relative movement such that the force required to elongate the non-extensible base layer is increased substantially. The polymer should also allow the non-extensible layer to remain flexible enough to permit mounting onto a printing cylinder.

If desired, the polymeric material may optionally be oriented in one or more directions to provide a higher tensile modulus. Optionally, the reinforced non-extensible base layer may be oriented to provide greater strength and greater resistance to stretching when subjected to normal forces encountered in the printing process. The desired orientation may be achieved using machine direction orientation, stentoring, calendaring, roll orientation, pultrusion, and the like.

Suitable reinforcing materials for use in the present invention include natural or synthetic materials including, but not limited to, nylon, cotton, rayon, wool, polyester, polypropylene, polyethylene, metals, carbon/graphite, and fiberglass. The reinforcing material may be in the form of fibers, cord, wire, woven or non-woven fabric or mesh, scrim, screen, film, and sheets. Any suitable reinforcing materials may be used as long as they provide the proper tension resistance while also being flexible enough to bend around a blanket cylinder for mounting.

The polymeric material is preferably incorporated into the reinforcing layer by coating, extrusion, pultrusion, laminating, molding, or any other suitable method which allows the polymer to flow substantially into the free space within the reinforcing material. The polymeric material is substantially impregnated into the reinforcing layer such that elongation of the reinforcing layer is restricted by the polymer matrix.

We have found that by impregnating the reinforcing layer with a polymeric material, the movement between the warp yarns, fibers, or fiber bundles, and fill yarns, fibers or fiber bundles is greatly restricted or "locked." Typical printing blankets are characterized by elongations of 1 to 3% with a load of 50 lbf/inch of width. Embodiments of the blanket of the present invention have elongations of less than about 0.2% at loads of 50 to 150 lbf/inch (about 8.9 to 26.8 kg-f/cm) of width.

Figure 2A:
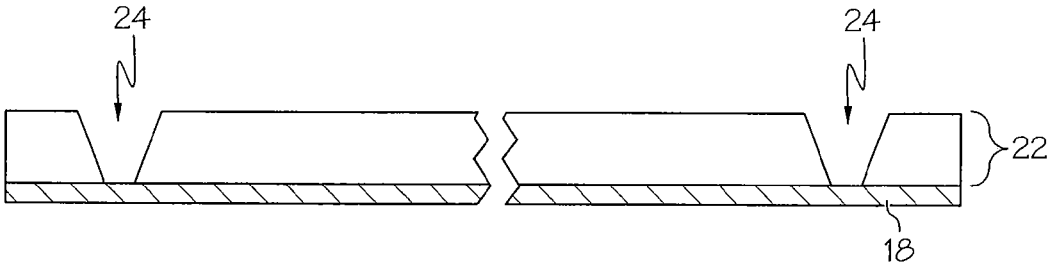
FIG. 2A is an enlarged elongated view of the blanket of FIG. 1 illustrating relief areas formed at each end of the blanket.

As further illustrated in FIG. 2A, in one embodiment of the invention, a portion 22 of the printing blanket above the non-tensioned backing layer 18 is preferably removed at each end of the blanket so as to form relief areas 24. The portion 22 of the blanket which is removed may include the surface printing layer, compressible layer, reinforcing layer(s), etc. As shown in FIG. 2A, the portion of the layers which has been removed forms a trapezoidal-shaped relief area.

The portions of the blanket are preferably removed by grinding, routing, skiving, cutting, ablating, or tearing. However, it should also be appreciated that the relief areas may be formed without removing a portion of the printing blanket. For example, the plies of the blanket may be molded or cast to form the desired relief configuration.

It should be appreciated that while trapezoidal-shaped relief areas are shown in FIG. 2A, different shaped relief areas may be provided as long as the areas allow the blanket to be fitted into the lock-up mechanism with the desired tensioning. For example, the relief area may also be triangular or rectangular in shape.

Figure 2B:
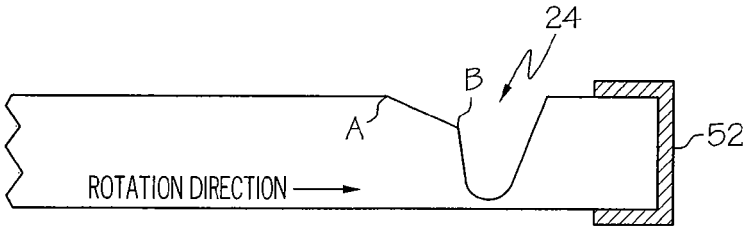
FIG. 2B is an enlarged view of one end of the printing blanket illustrating a preferred shape of the relief areas.

The most preferred relief shape is illustrated in FIG. 2B, which includes a beveled or contoured area 24 on the printing surface positioned at the start of the relief for at least the leading edge of the blanket as it rotates into the plate and printing nips. This beveled or contoured surface provides a reduced impact force as the blanket enters into the nip between the blanket and the printing plate and into the nip between the blanket and the printed substrate (paper) during normal press operation, thus providing reduced wear of the blanket surface, printing plate, and press equipment.

As shown, the bevel/contour starts at point "A" and slopes away from the printing surface at a slight angle (10 to 30 degrees measured from the surface) and extends to a depth below the printing surface equal to approximately 0.005 to 0.010 inches (0.12 to 0.25 mm) at point "B." The remaining portion of the relief may be any convenient shape. Optionally, the beveled or contoured surface may be achieved by positioning the start of the relief so that the blanket and blanket printing surface extends a short distance beyond the point at which the non-extensible base must be bent to fit into the press lockup. Preferably, the relief is positioned on the circumference of the blanket cylinder so that it closely aligns to the point at which the lockup gap begins and at the point where the blanket/non-extensible base must be bent sharply to fit into the lockup. This optimum positioning results in maximum printing length by placing the non-tensioned portion of the printing layer of the blanket closest to the edge of the lockup gap without extending substantially down into the gap. Also as shown in FIG. 2B, the ends of the blanket may include a blanket lockup bar 52. In addition to or as an alternative to the use of blanket bars, the ends of the blanket may be formed into a desired shape for fitting into a lockup mechanism. For example, the blanket ends may be formed by cold forming (bending), thermoforming, or solvent forming (softening with a solvent so that shaping can be achieved). The blanket ends may be formed as desired during blanket manufacture, when the relief area is formed, or just prior to mounting on a press.

Figure 3:
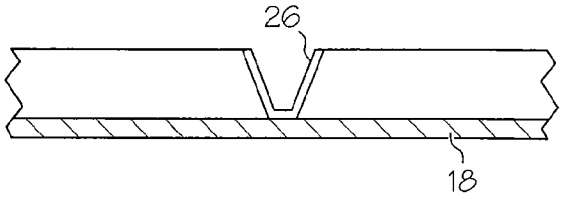
FIG. 3 is a view of the blanket of FIG. 2A further illustrating a sealant in the relief area of the blanket.

In the embodiment shown in FIG. 3, an optional sealant 26 is preferably applied to the relief areas to prevent the entry of water, inks, or chemicals into the exposed edges of the blanket. The sealant may comprise any conventional sealant that provides chemical and moisture resistance including, but not limited to, epoxies, hot melts, polyamides, polyesters, polyurethanes, moisture, UV and RF curable adhesives, fluorosilicones, fluoropolymer-based materials, and acrylic-based sealants and adhesives.

Figure 4A:
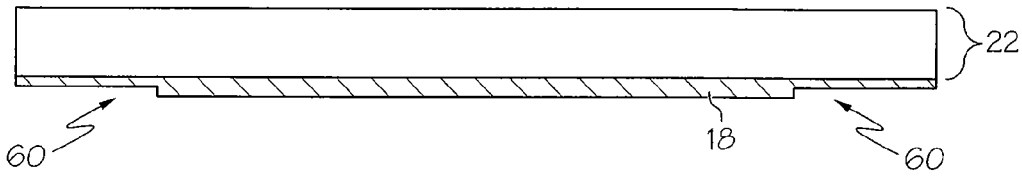
FIG. 4A is an enlarged view of a printing blanket including a relief area formed in the non-extensible backing layer at each end.
Figure 4B:
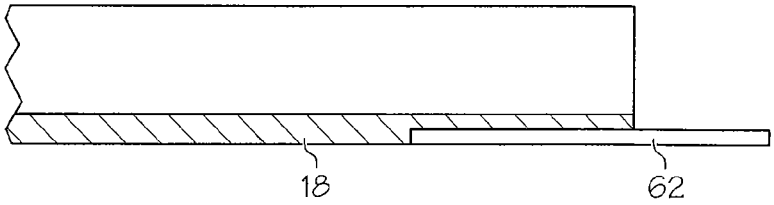
FIG. 4B is an enlarged view of the blanket of FIG. 4A including a blanket bar attached to the relief area.

Referring now to FIGS. 4A and 4B, an alternative embodiment of the blanket is shown in which relief areas 60 are provided in the non-extensible layer 18 at each end of the blanket. The relief areas are preferably formed by grinding, skiving, cutting or any other means which provides the desired relief configuration. However, it should be appreciated that the relief areas may be formed without removing a portion of the non-extensible layer. For example, a portion of the non-extensible layer of the blanket may be molded or cast to form the desired relief configuration. As shown in FIG. 4B, a blanket bar or tab 62 is preferably attached to the relief areas 60 at each end of the blanket. The blanket bar may be attached to the ends of the blanket by crimping or gluing. The blanket bar or tab 62 is preferably comprised of a material such as aluminum, stainless steel, a reinforced polymeric material, or any other material which may be bent or formed for insertion into a lockup mechanism. A preferred bar material is stainless steel having a thickness of about 0.006 to 0.012 inches (0.15 to 0.30 mm).

An alternative bar material may comprise a polymer or reinforced polymer that may be bent or formed for insertion into the lockup. The blanket bar(s) are preferably designed to be bent or formed and fitted into a plate lockup mechanism of a blanket cylinder as will be described in further detail below. Suitable forming methods include cold forming (such as, for example, bending), hot forming (where the material is a polymer, this would encompass thermoforming), or solvent forming (for example, using a solvent to soften a polymer so that it can easily be bent to the desired shape).

Figure 5:
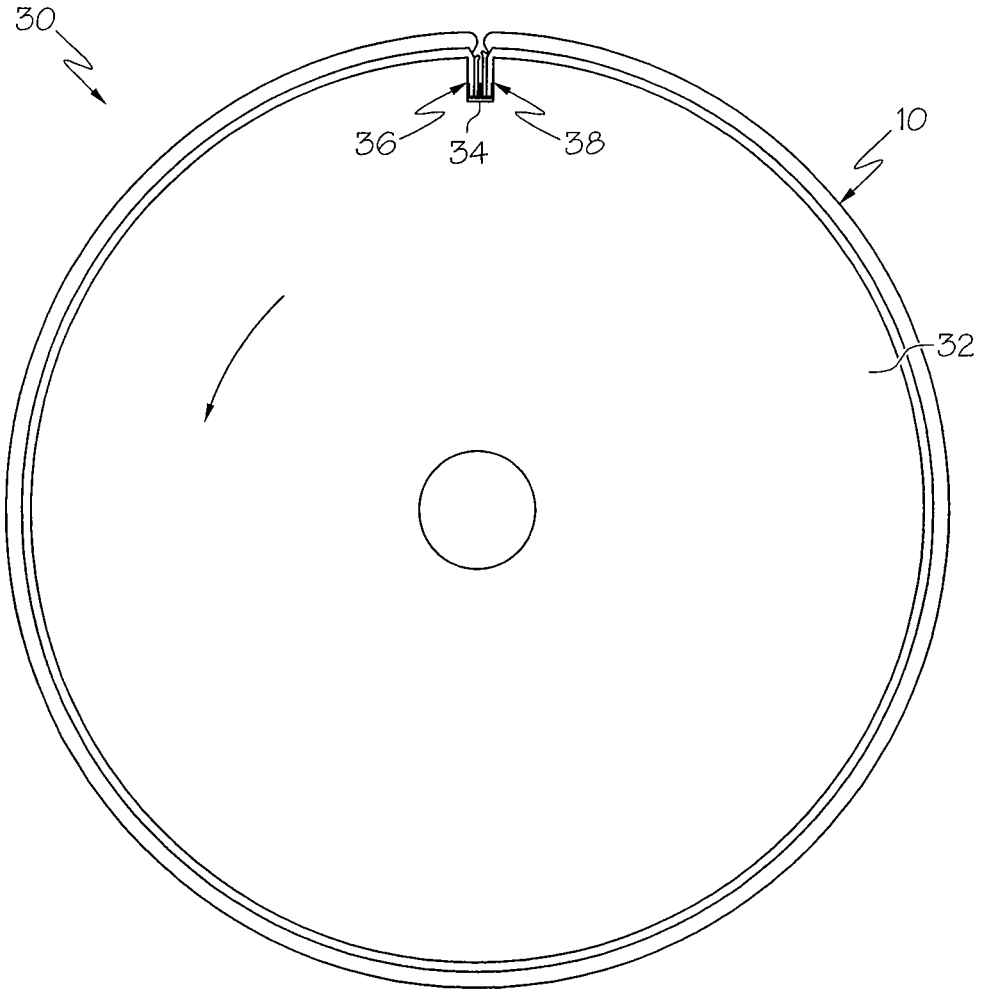
FIG. 5 is a schematic view of the printing blanket of FIG. 2B mounted on a blanket cylinder.

The printing blanket including the relief areas allows the blanket to be used in substantially all types of conventional lock-up mechanisms. FIG. 5 illustrates a portion of a typical offset lithographic printing apparatus 30 which includes a blanket cylinder 32 with printing blanket 10 mounted thereon, where the printing blanket includes relief areas formed from a portion of the printing blanket layers. The blanket cylinder 32 includes an axially-extending gap 34 having first and second edges 36 and 38, respectively, which form a gap having a width W (see FIG. 5A). It should be appreciated that the lockup shown in FIG. 5A has been illustrated in general form to represent most conventional lockup mechanisms.

Figure 5A:
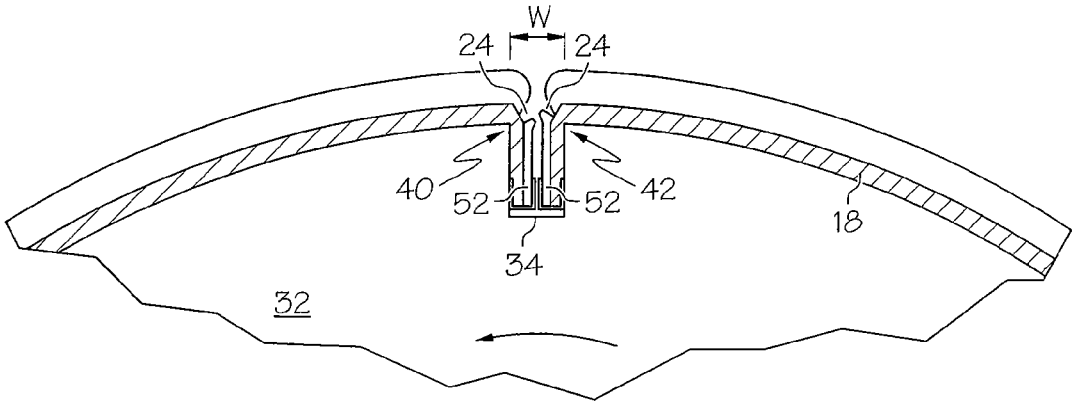
FIG. 5A is an enlarged view of a portion of the printing blanket of FIG. 5 showing detail of the gap into which the ends of the printing blanket are mounted.

FIG. 5A is an enlarged view of the printing blanket in the area of the gap. As shown, the leading and trailing ends 42, 40 of the printing blanket including the non-extensible layer 18 are bent and inserted into the gap 34 to secure the blanket to the blanket cylinder 32. The ends 42, 40 are preferably secured to blanket bars 52. As shown, the relief areas 24 allow the ends of the blanket to be easily bent and inserted into the gap. Preferably, the relief areas are positioned on the circumference of the blanket cylinder so that they closely align to the point at which the lock-up gap begins and at the point where the blanket/non-extensible base must be bent sharply to fit into the lock-up.

Figure 6:
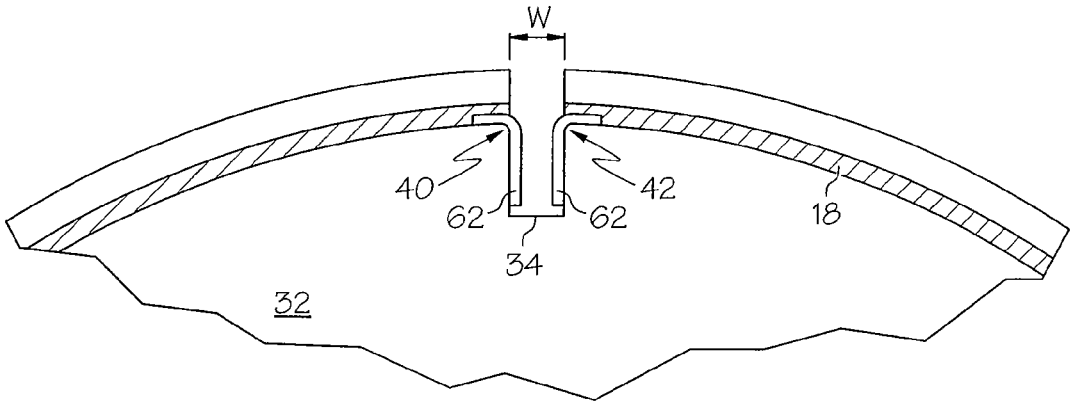
FIG. 6 is an enlarged view of a portion of the printing blanket of FIG. 4B mounted in the gap of a blanket cylinder.

FIG. 6 illustrates an enlarged view of the printing blanket of FIG. 4B mounted in the area of the gap. As shown, the blanket bars 62 attached to the relief areas at the leading and trailing ends 40, 42 of the printing blanket are bent and inserted into the gap 34 to secure the blanket to the blanket cylinder 32. It should be appreciated that the lockup shown in FIG. 6 has been illustrated in general form to represent most plate lockup mechanisms.

Having described the invention in detail and by reference to preferred embodiments thereof, it will be apparent that modifications and variations are possible without departing from the scope of the invention.

What is claimed is:

1. A printing blanket mounted on a blanket cylinder, said blanket cylinder including a gap and a lockup mechanism within said gap; said printing blanket comprising at least a printable surface ply and a non-extensible backing layer comprising a polymeric material or a reinforcing material which has been impregnated with a polymeric material, said printing blanket having first and second ends inserted into said gap; wherein at least a portion of said blanket overlying said non-extensible backing layer and spaced inwardly from at least one end of said blanket has been removed or molded to form at least one relief area which extends across substantially the width of the blanket and which is defined by blanket walls on each side; wherein said at least one relief area is positioned in said gap immediately above said lock-up mechanism; and wherein said at least one relief area is adapted to permit the blanket to be fitted into said lockup mechanism without a reduction in gauge.

2. The printing blanket of claim 1 including a compressible ply positioned beneath said surface ply.

3. The printing blanket of claim 2 including at least one reinforcing fabric ply positioned beneath said compressible ply.

4. The printing blanket of claim 1 including at least one reinforcing fabric ply positioned beneath said surface ply and a compressible ply positioned beneath said reinforcing fabric ply.

5. The printing blanket of claim 3 wherein said portion of blanket which has been removed or molded comprises said printable surface layer, said compressible layer, and said at least one reinforcing fabric ply.

6. The printing blanket of claim 4 wherein said portion of blanket which has been removed or molded comprises said printable surface layer, said compressible layer, and said at least one reinforcing fabric ply.

7. The printing blanket of claim 1 wherein said non-extensible backing layer comprises an oriented polymeric material.

8. The printing blanket of claim 1 wherein said non-extensible backing layer comprises a polymeric material selected from thermoplastic and thermosetting polymers.

9. The printing blanket of claim 1 wherein said non-extensible backing layer comprises a reinforcing material selected from fibers, cord, woven or non-woven fabric, mesh, scrim, screen, film, and sheets.

10. The printing blanket of claim 1 wherein said non-extensible backing layer is oriented in at least one direction.

11. The printing blanket of claim 1 wherein said non-extensible backing layer has a thickness of from about 0.008 inches to about 0.025 inches (about 0.2 mm to about 0.6 mm).

12. The printing blanket of claim 1 including a sealant on at least a portion of the surface of said at least one relief area.

13. The printing blanket of claim 1 having an elongation of less than about 0.2% at loads of about 50 to 150 lbf/inch (about 8.9 to 26.8 kg-f/cm) of width.

14. The printing blanket of claim 1 wherein said at least one relief area has a triangular, rectangular, or curved cross-section.

15. The printing blanket of claim 1 wherein said at least one relief area has a trapezoidal cross-section.

16. The printing blanket of claim 14 including a beveled edge portion on said relief area.

17. The printing blanket of claim 15 including a beveled edge portion on said relief area.

18. The printing blanket of claim 16 wherein said beveled edge forms an angle of from about 10° to 30° with the surface of said blanket.

19. The printing blanket of claim 1 having a relief area spaced inwardly from each of said first and second ends of said blanket.

20. The printing blanket of claim 1 wherein said blanket has been formed at each end by cold forming, thermoforming, or solvent forming.

21. The printing blanket of claim 1 including blanket bars attached to said first and second ends.

* * * * *